United States Patent [19]

McShane

[11] Patent Number: 4,847,904

[45] Date of Patent: Jul. 11, 1989

[54] AMBIENT IMAGING LOUDSPEAKER SYSTEM

[75] Inventor: Charles L. McShane, Mount Prospect, Ill.

[73] Assignee: Boston Acoustics, Inc., Peabody, Mass.

[21] Appl. No.: 176,796

[22] Filed: Apr. 1, 1988

[51] Int. Cl.[4] ..... H04R 5/00; H04R 1/02

[52] U.S. Cl. ..... 381/24; 381/89; 381/90

[58] Field of Search ..... 381/1, 24, 88–90

[56] References Cited

U.S. PATENT DOCUMENTS

| | | | |
|---|---|---|---|
| 4,418,243 | 11/1983 | Fixler | 381/24 |
| 4,504,704 | 3/1985 | Ohyaba et al. | 381/90 |
| 4,569,074 | 2/1986 | Polk | 381/24 |
| 4,586,192 | 4/1986 | Arnston | 381/24 |
| 4,630,298 | 12/1986 | Polk et al. | 381/24 |
| 4,759,066 | 7/1988 | Polk et al. | 381/24 |

FOREIGN PATENT DOCUMENTS

| | | | |
|---|---|---|---|
| 1454894 | 11/1976 | United Kingdom | 381/24 |

*Primary Examiner*—Jin F. Ng
*Assistant Examiner*—David H. Kim
*Attorney, Agent, or Firm*—Schiller, Pandiscio & Kusmer

[57] ABSTRACT

Sound reproduction apparatus comprising a pair of loudspeaker systems each including a plurality of loudspeakers for producing audio signals in response to respective electrical right (R) and left (L) stereophonic signals. Each system is mounted in an enclosure with sides and a gabled or V-shaped front portion characterized in having a pair of flat, vertical panels each joined to respective ones of the sides, the panels being joined at an intersecting angle to one another of about 90 to about 120 degrees at a forwardly projecting vertical ridge. Each system has a tweeter, woofer and mid-range speaker all connected for monophonically reproducing only a respective one of the stereophonic signals, and positioned in first ones of its panels. Each system also includes at least a second mid-range speaker connected for reproducing only a difference output between the stereophonic signals by using a dual voice coil driver, the second mid-range speaker being positioned in the other of its panels. When arranged side by side and spaced apart, the difference outputs are directed away from both speakers and the monophonic outputs are directed approximately toward one another. The entire apparatus is wired so that the monophonic R output produced by the one system is produced out-of-phase with the respective R component of the difference output of the associated second midrange speaker, and similarly the L output of the other system is out-of-phase with the respective L component of the difference output from its associated second midrange speaker.

12 Claims, 2 Drawing Sheets

AMBIENT IMAGING LOUDSPEAKER SYSTEM

This invention relates to sound reproduction, and particularly to apparatus for reproducing sound from a pair of stereophonic loudspeakers to provide decreased localization effects due to listener proximity to either of such speakers.

Modern loudspeaker apparatus is characterized by an arrangement of one or more individual loudspeakers in such a way as to provide full range radiation of audio frequencies. The term "loudspeaker" as used herein is intended to refer to an individual electroacoustic transducer for reproducing audio signals, and which may be horn-coupled, direct radiation, magnetic or electrostatic or ribbon designs and may have different sound pressure directional characteristics. Regardless of the technique employed they may in one way or another interact with the boundaries of the listening room in such a way as to create characteristic spatial effects which combine to obscure the dimensional information contained in modern stereophonic recordings and broadcasts.

Stereophonic recordings or broadcasts rely for their dimensional content on the spacing of left and right microphones. The phase and amplitude difference between what is recorded or transmitted on the left versus the right component can enable the ear-brain mechanism to be persuaded that the event has spatial reality in spite of the listening room contribution. In other words, verbatim physical reality is not required for the ear-brain combination to selectively "tune out" the real room's time and amplitude information and "hear" the event with whatever spatial signature is in the program material.

However, for the listener's mind to be convinced that it is receiving a stereophonic image, audio reproduction of the left and right channel information must reach the listener's left and right ears independently and in a coherent time sequence. The term "coherent" is used herein in the sense that the coherent part of a sound field is that part of a wave velocity potential which is equivalent to that generated by a simple or point source in free space conditions, i.e. is associated with a definite direction of sound energy flow or ordered wave motion. "Incoherent" sound then includes those other components constituting the velocity potential of a sound field in a room that are associated with no one definite direction of sound energy flow. The two principal elements in lateral localization of sound are time (phase) and intensity. A louder sound seems closer and a sound arriving later in time seems further away. The listener will employ both ears and the perceptive interval between the two ears to establish lateral localization. This is known as the Pinnar effect, often discussed in terms of interaural cross-correlation.

It is possible to frustrate the ear-brain mechanism localizing ability by employing certain artificial clues such a deliberate phase shifts. Most prior art loudspeakers did not employ such techniques because no universally accepted first-order "model" exists. Prior art loudspeakers ignoring both room interaction and recording techniques have concentrated their efforts on the loudspeaker as a power device. Design efforts have been directed at providing the most uniform total radiated power response. This ensures that the perceived output may have accurate instrumental timbre but it does not insure that the listener will hear a dimensionally convincing version of the original sound from a wide range of positions in normal listening rooms. Such products have dominated the commercial loudspeaker market since the advent of stereophonic recording, constituting the bulk of the prior art.

For most stereophonic reproduction devices, the respective stereo signals are typically reproduced by apparatus that incorporates a plurality of loudspeakers, usually of different frequency characteristics, mounted in spatially fixed relation to one another in an enclosure, such apparatus being hereinafter referred to as a loudspeaker system.

In such a typical prior art arrangement, a listener with normal hearing is positioned in front of and equidistant from equivolume radiating speakers of a pair of such loudspeaker systems, the right and left loudspeaker systems respectively reproducing the right and left stereo channels essentially monophonically. In such case, the listener will perceive equal-sound amplitude, early-arrival components along with room reflected ambient versions of the sound arriving later in time. Independent left ear and right ear perception may be compromised by some left ear perception of the right channel around the head dimension, and vice versa. The perception of these interaural effects is in the early arrival time domain so that the later arrival room reflections do not ameliorate the diminished perceptions of the left and right difference component.

As the listener moves into position closer to, for example, the left loudspeaker system than the other, the effect worsens. The output from the right and thus more distant loudspeaker system appears reduced until sound from only the nearer left loudspeaker system envelopes the listener. Since the stereophonic effect of two sets of microphones with finite physical spacing depends on the listener's perception of the difference between channels, the reduction to the left channel (or right) destroys the already interaurally compromised left-right signal.

Critical listeners have often expressed a preference for sound reproduced through stereophonic headphones. The latter isolate the recorded, time-related ambience by blocking out impinging ambience of the listening room. Notwithstanding the discomfort and limited acoustic performance, principally in the bass register, for audiophiles headphones have been a valid alternative to loudspeakers.

In the past several years, however, serious efforts have been made by loudspeaker designers to overcome some of the acoustic problems with loudspeaker systems noted above.

For example, the system described in U.S. Pat. No. 4,568,192 issued Apr. 26, 1986 to L. E. Arnston, FIG. 2, purports to contribute to improved perception of both channels (and thus the difference component) through the use of a second "enhancement" voice coil winding wired to the opposite channel and connected in a reversed polarity sense and filtered to provide simulation of the attenuation around the human head between left and right ear. This coil is mechanically coupled to the primary cone in common with the unfiltered primary winding. The primary coil is connected to provide a fully functional and coherent left or right sound component with the secondary or "enhancement" coil winding equalized to augment the difference component. Thus, the listener hears a normal left or right hand component with an attenuated filtered opposite channel superimposed. This design ensures an augmented difference component emanating from the same physical space as the primary near field of either left or right loudspeaker system. However, as the listener moves into the near field of either loudspeaker system, the output of the nearer system dominates while the more distant system is perceived primarily from its attenuated far field ambient output. Since the difference L-R or R-L component cannot be physically isolated from the primary information, it is not possible to exploit fully the listening room far-field ambience, because the same radiating element must provide the primary left or right information along with the "enhancement" of the secondary opposite channel windings.

Polk, in U.S. Pat. No. 4,569,074 describes a system aimed at cancellation of interaural crosstalk effect primarily for a listener equidistant from left and right stereo loudspeaker systems. Polk provides an extensive analysis predicated on a listener situated equidistant between left and right loudspeaker systems with left and right subspeakers disposed "out-board" at approximately an interaural spacing. These subspeakers radiate a pure difference L-R or R-L component by crosschannel wiring within the left and right amplifier channels. Unfortunately, some commercial amplifier designs react unfavorably to such cross-channel connections, so there is some potential for degraded amplifier performance. Additionally, the design is sensitive to listener proximity to either loudspeaker system. Also, this L-R or R-L component does not radiate a usable left or right signal, and there is no psychoacoustic difference between L-R or R-L; these latter difference signals are non-coherent stereophonic derivations designed to augment either channel.

In another version described by Polk in U.S. Pat. No. 4,497,064, the subspeakers eschew the L-R/R-L configuration in favor of minus R on the left loudspeaker system and minus L on the right loudspeaker system. Again, the purpose is to overcome interaural cancellation effects with an out-of-phase attenuated component. This design is also sensitive to the proximity of a listener to either speaker system and is useful primarily for a listener approximately equidistant between the two speaker systems. This Polk design bears some resemblance to the system described by Montcrief in U.S. Pat. No. 4,596,034 issued June 17, 1986, in that the subspeaker in the latter is in reverse phase-polarity to the primary speaker in the system and an acoustic null would, therefore, be expected in the forward radiating area.

Other methods of image expansion utilize high impedance devices which accomplish the required L-R phase reversal at the "front-end" of the amplifier preamplifier. In addition, equalization circuitry may be incorporated as taught in U.S. Pat. No. 4,503,553 issued March 1983 to M. Davis. The risk of electronic noise or signal degradation are, of course, present when separate high impedance devices are employed.

A principal object of the present invention is to provide a stereophonic loudspeaker system designed to facilitate listener perception of recorded ambience distinct and separate from the listening room acoustic effects. Another important object of the present invention is to provide a method of providing more uniform listener perception of both left and right reproduced stereophonic channels relatively independently of room location of the reproduction equipment vis-a-vis the listener. Yet another object of the present invention is to provide a pair of stereophonic loudspeaker systems that has an apparent sound stage width with dimensions outside the spacing of the two loudspeakers systems.

To achieve these and other objects the present invention generally is embodied in apparatus comprising at least a pair of loudspeaker systems (i.e. a collection of loudspeakers mounted and arranged to bear a fixed spatial relation to one another) for producing audio signals in response to respective electrical right (R) and left (L) stereophonic signals. As well known, such systems typically include a woofer, midrange speaker and tweeter, together with whatever cabinetry, baffling and mounting means are desired. The individual loudspeakers are electrically connected or wired to one another so that one or more speakers of one system (intended to be placed toward the right hand side of a listener) reproduce only the right stereophonic signals (R) and one or more speakers of the other system (intended to be placed toward the left hand side of a listener) reproduce only the left stereophonic signals (L). At least one or more difference speaker in the system reproducing the R signals also is wired to generate a synthetic audio difference output (L-R) from the right and left stereophonic input signals. Similarly, the system reproducing the L signals includes a difference speaker wired to generate a synthetic audio difference output of (R-L). In each system, the speakers are disposed at geometric angles designed to provide diminished perceived output in the zone directly in front of the two loudspeaker systems as well as imaging effects outside the spacing of both speakers created by the added L-R and R-L audio outputs. The audio outputs from the difference speakers is achieved simply by providing each such difference speaker with a dual voice coil that drives only a single cone or the like, and such difference speakers are preferably middle frequency or midrange speakers. The difference component or audio output is non-coherent in the sense that the composite driver has no perceived left or right orientation. This reverse polarity coupling of equal dual drives to a single radiating element effectively suppresses equal amplitude in-phase electrical signals that appear simultaneously to both sets of inputs.

Other objects of the present invention will in part be obvious and will in part appear hereinafter. The invention accordingly comprises the apparatus possessing the construction, combination of elements and arrangement of parts, and the method including the several steps and the relation of one or more of such steps with respect to each of the others, all of which are exemplified in the following detailed disclosure and the scope of the application of which will be indicated in the claims.

For a fuller understanding of the nature and objects of the present invention, reference should be had to the following detailed description taken in connection with the accompanying drawings wherein.

Figure 1:
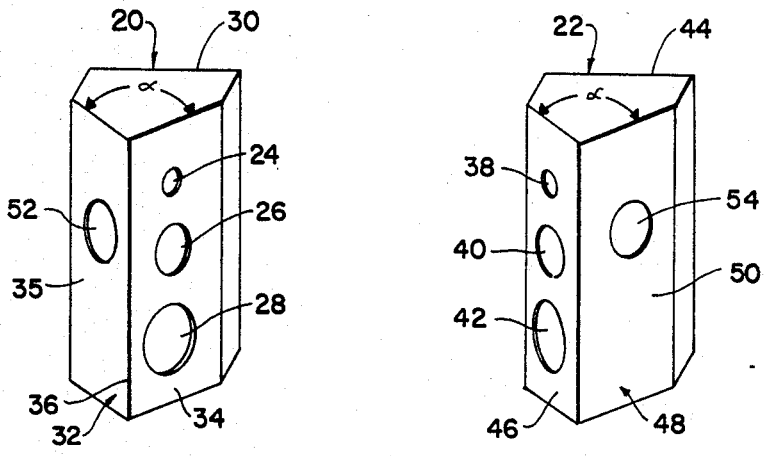
FIG. 1 is a perspective view of a pair of loudspeaker systems incorporating the principles of the present invention.

Referring now to FIG. 1, there is shown a perspective view of a typical pair of loudspeaker systems 20 and 22. System 20 includes, preferably but not necessarily, a trio of loudspeakers: tweeter 24, midrange speaker 26 and woofer 28 typically being mounted in enclosure 30. The latter is essentially a rectangular box with a gabled or V-shaped front portion 32 characterized in having two, flat, vertical panels 34 and 35 each joined to respective sides of enclosure 30 and joined to one another at forwardly projecting vertical ridge or linear apex 36, thereby forming an angle, preferably of between about 90° to about 120° to one another, i.e. the angle shown in FIG. 5. In the form shown, speakers 24, 26 and 28 are disposed in a vertical line along right-hand panel 34 (viewing the front of loudspeaker system 20) so that they all can radiate sound about respective horizontal axes lying parallel to one another in a common vertical plane.

Similarly, system 22 comprises tweeter 38, midrange speaker 40 and woofer 42 mounted in enclosure 44 on left-hand panel 46 of V-shaped front portion 48. The latter also includes right-hand panel 50 joined to left-hand panel 46 at an angle of about 90° to about 120°. It will be seen that loudspeaker systems 20 and 22 are thus essentially mirror image duplicates of one another.

Figure 5:
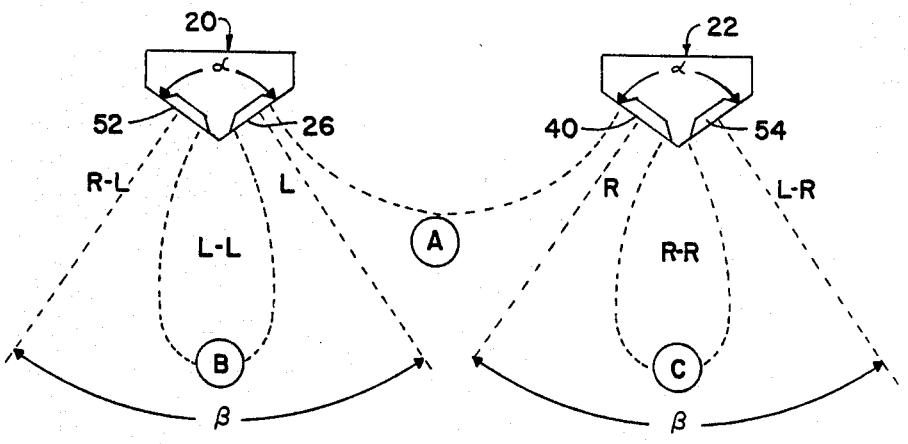
FIG. 5 is a schematic plan view showing the various sound zones typically produced by the pair of loudspeaker systems of FIG. 1.

Loudspeaker system 20 also includes at least one speaker 52 mounted in left-hand panel 35 so as to be capable of radiating sound about an axis that is also about 90 to about 60 in a horizontal plane from the intersection of that plane with the vertical plane of the radiation axes of speakers 24, 26 and 28, as shown as angle in FIG. 5. Similarly, loudspeaker system 22 also includes at least one speaker 54 mounted in right-hand panel 50 so as to be capable of radiating sound about a horizontal axis that is also about 90 to 60 from the plane of the radiation axes of speakers 38, 40 and 42. Loudspeaker systems 20 and 22 are intended to be disposed with respect to a listener so that the sound radiation axes of speakers, 50 and 52 diverge from one another and the planes of the radiation axes of the other speakers converge in front of the loudspeaker systems.

Figure 2:
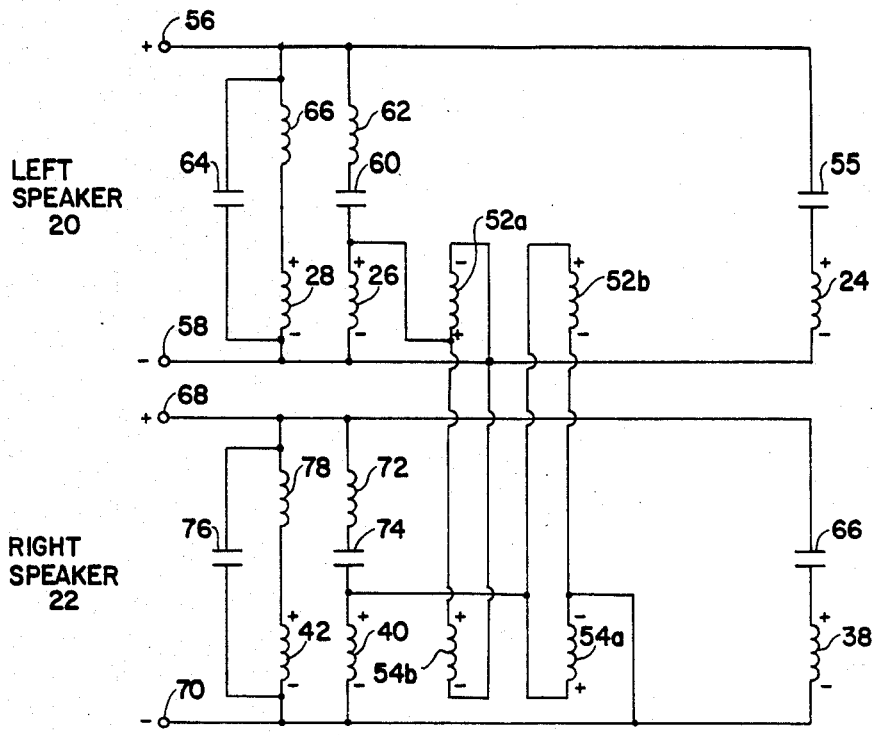
FIG. 2 is a schematic wiring diagram illustrating the connection among the driver coils of the drivers of the loudspeaker systems of FIG. 1.

As shown in FIG. 2, speakers 24, 26 and 28 (represented by the driving coils identified by those reference numerals) are all connected in like polarity to a source (not shown) of L signals, through corresponding filters to allocate the frequency ranges to be reproduced by each. Thus, coil 24 is connected in series with capacitor 55 between positive input terminal 56 and negative input terminal 58, capacitor 55 representing then a high pass filter. Similarly, coil 26 is connected between terminals 56 and 58 in series with a mid-range filter represented by series-coupled capacitor 60 and inductor 62, and coil 28 is connected between terminals 56 and 58 through a low-pass filter represented by paralleled capacitor 64 and inductor 66.

Speaker 52 includes a pair of driver coils 52*a* and 52*b*, the former being connected between negative terminal 58 and the junction between mid-range coil 26 and its mid-range band-pass filter, but wound in opposite polarity to coil 26, i.e. to reproduce the same signals in the same frequency range as coil 26 but substantially 180° out of phase with the latter.

Also as shown in FIG. 2, speakers 38, 40 and 42 (represented by the driving coils identified by those reference numerals) are all connected in like polarity to a source (not shown) of R signals, through corresponding filters to allocate the frequency ranges to be reproduced by each. Thus, coil 38 is connected in series with capacitor 66 between positive input terminal 68 and negative input terminal 70, capacitor 66 representing then a high pass filter. Similarly, coil 40 is connected between terminals 68 and 70 in series with a mid-range filter represented by series-coupled capacitor 74 and inductor 62, and coil 42 is connected between terminals 68 and 70 through a low-pass filter represented by paralleled capacitor 76 and inductor 78.

It will thus be apparent that the left and right components, R and L, are derived independently from the appropriate channel and each winding of the woofer, mid-range and tweeter is connected into the cross-over network in the normal manner.

Speaker 54 includes a pair of driver coils 54*a* and 54*b*, the former being connected between negative terminal 58 and the junction of mid-range coil 40 and its mid-range band-pass filter, but wound in opposite polarity to coil 40. Coil 54*b* is connected in parallel and therefore in like polarity with coil 52*a* between negative terminal 58 and the junction of coil 26 and its associated filter. Similarly, coil 52*b* is connected in parallel with coil 54*a* between negative terminal 70 and the junction of coil 40 and its associated filter.

Figure 3:
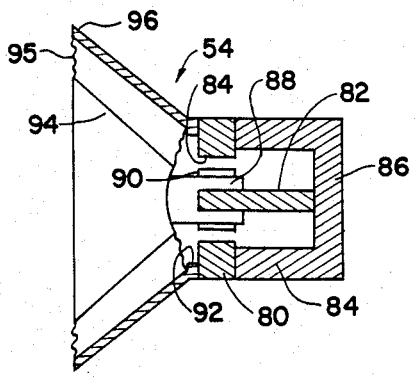
FIG. 3 is an idealized cross-section of the dual coil midrange driver shown schematically in FIG. 2.
Figure 4:
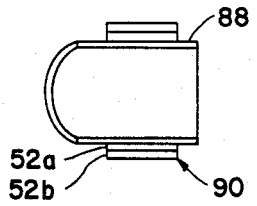
FIG. 4 is an exaggerated view of the cross-section of the bobbin and windings of the embodiment of FIG. 3.

As shown in FIGS. 3 and 4, speaker 54, exemplary also of speaker 52, includes the usual prior art components comprising annular magnetic pole piece 80 and cylindrical permanently magnetized pole piece 82 extending into the aperture in pole piece 80 in spaced-apart relation to leave annular magnetic gap 84 between the pole pieces. Pole piece 82 is typically mounted on iron frame 86 which completes the magnetic path between the pole pieces. Disposed in gap 84 is bobbin 88 about which voice coil 90 is wound. The outboard end of bobbin 88 is supported by centering disc or spider 92 mounted on frame 86, the end of bobbin 88 being mechanically coupled to the narrower end of cone 94. The wider end of cone 94 is mechanically supported by compliant rim suspension means 95 connected to mounting ring 96, the latter being supported by arms (not shown) extending from frame 86.

In the present invention, voice coil 90 is formed of dual voice coils 52*a* and 52*b* both wound about bobbin 88, preferably in a center-tapped series-wound four layer design with each two layers comprising an independent dedicated left or right channel. Thus the magnetic field produced jointly by the two distinct windings in coil 90 serve to control the excitation of one diaphragm so that the latter will provide an audio reproduction of an R-L signal. It will be appreciated that in the counterpart structure of speaker 54, coils 54*a* and 54*b* are also arranged to generate an audio reproduction of an L-R signal. Speakers 52 and 54 preferably respectively include damped sub-enclosures to provide acoustic isolation as well as a mechanical high pass filter effective, for example, at 275 Hz. The filtered inter-channel (left vs. right) isolation in such a dual voice coil driver is typically 80 db or more.

Thus, a monophonic input applied to such a dual voice coil driver would be non-functional, i.e. generate no signal, since the operation of the dual voice coil driver depends on either phase or amplitude differences. In terms of manufacturing and design, the dual voice coil aspect of the present invention is a cost-effective manner of acquiring an ambient L-R R-L acoustic component.

FIG. 5 shows the geometric spacing of loudspeaker systems 20 and 22 of the present invention during proper operation, and illustrates the angles of sound radiation and perception relative to listeners at various points in a normal listening room. "Balloons" L-L and R-R delineated in dotted line and radiating respectively directly in front of speaker systems 20 and 22, indicate approximate areas of subtractive output due to polarity-phase relationship between left winding 52*a* of the dual voice coil driver in speaker 52 and the voice coil of left primary mid-range speaker 26. The configuration for speaker system 22 is conversely equivalent.

In position A noted in FIG. 5, equidistant and slightly in front of a line between speaker 20 and 22, the output from speakers 52 and 54 are "shadowed" by the cabinet shape. Thus the listener receives L-R and R-L at the listener's equidistant location relative to the in-board radiating left and right channels represented here for the sake of simplicity only by mid-range speakers 26 and 40 primarily as late arrival distance components reflected off of the walls of the listening room. In addition, interaural cancellation is diffused and diminished by the late arrival difference components from speakers 52 and 54 aimed away from the listener towards the far corners and back walls of average residential listening rooms. The distances involved usually involve a delay of at least 20 ms (about 18').

In a dynamic sense, the transient appearance of material arriving from both channels makes it possible to examine the individual polarity of both windings of the dual voice coil. For a listener in position (B), directly in front of loudspeaker system 20, an L component appearing momentarily in left winding 52*a* of the dual voice coil driver will be perceived in opposite polarity to the L signal output from adjacent left mid-range speaker 26. The output of the L signals from left loudspeaker system 20 in the zone directly in front of the system will be momentarily out-of-phase with one another and accordingly attenuated as illustrated in the balloon marked L-L.

The width of this out-of-phase "balloon" will be controllable by the angular geometry, spacing, and band width of speakers 52 and 54. Experiments have shown that an angle $\beta$ as shown in FIG. 5, of between about 90 degrees to about 60 degrees between the radiation axes of speakers 26 and 52 provides a diminished output zone while "shadowing" the more distant opposite channel speaker 54. As the listener moves from the extreme left to right he remains aware of the speaker furthest from him. These experiments used a space between speakers 52 and 26 slightly greater than interaural ear-spacing, e.g. about eight inches. The −3 db downpoint was optimized at 1800 Hz and 300 Hz, and output from the dual voice coil speakers was attenuated relative to the primary or R and L speakers by 3 db.

Referring again to the listener at position B, and recalling that the phase reversed L component in the output from speaker 52 appears only momentarily (on a dynamic basis), consider the R component in that output. It too appears on a dynamic basis but its polarity is that of the positive in-phase right channel. Thus at position B a listener will perceive the more distant loudspeaker augmented in output by the R component in the output from speaker 52.

Experiments have shown that a listener in position B will perceive an augmented right stereo component as well as the diminished closer left component. Obviously the reverse situation occurs as the listener moves about the room finally coming into the proximity of the right speaker system, for example at position C. The right to left transitions occur in such a way that the listener is always aware of the more distant speaker regardless of in which direction he moves relative to the equidistant axis between left and right speakers. Since speakers 52 and 54 are aimed into the far field of the listening room, the ambient nature of their contributions is reinforced by the time delay of the room's longer dimension.

The precise amount of boundary expansion perceived outside the space between speaker systems 20 and 22 depends primarily on the information being reproduced. A mirror image between the microphone spacing of the source material and the image generated by the loudspeaker systems is frustrated by the common use of multiple microphones and multiple channel mixdowns. Even so, the perception of a strong difference component as provided by the instant invention, in any position in a normal listening room, augmented by the ambience of the room, can be convincing if not verbatim. Notwithstanding then the nature of modern stereophonic recording and broadcasts, the present invention permits one to expand the acoustic image and to make the stereophonic experience relatively independent of listening room position.

While a preferred embodiment of the present invention has been described herein and illustrate in the drawings, modifications which do not depart from the essence of the invention may be made, and indeed, in view of the foregoing disclosure should now be apparent to those knowledgeable in the loudspeaker art. Accordingly, it is intended that the present invention not be limited by the precise structure illustrated and described, but rather that the scope of the invention be construed in accordance with the appended claims.

What is claimed is:

1. Sound reproduction apparatus comprising:

a first loudspeaker system including a plurality of loudspeakers for producing audio signals in response to respective electrical right (R) and left (L) stereophonic signals:

at least a first of said loudspeakers being-connected for reproducing only one of said stereophonic signals;

at least a second of said loudspeakers having a dual voice coil wired and connected for producing an audio output signal representing only the difference between the other of said stereophonic signals and said one of said stereophonic signals; and means for mounting said first loudspeaker for radiating sound along a first axis away from said second loudspeaker, and for mounting said second loudspeaker for radiating sound away from said first loudspeaker along a second axis at an acute angle to said first axis.

2. Sound reproduction apparatus as defined in claim 1 including:

a second loudspeaker system comprising a plurality of loudspeakers for producing audio signals in response to said electrical right (R) and left (L) stereophonic signals, at least one of said loudspeakers in said second loudspeaker system being connected for reproducing said other of said stereophonic signals;

at least another of said loudspeakers in said second loudspeaker system having a dual voice coil wired and connected for producing an audio output signal representing the difference between said one of said stereophonic signals and said other of said stereophonic signals; and means for mounting said one of said loudspeakers for radiating sound along first axis away from said another loudspeaker, and for mounting said another loudspeaker for radiating sound away from said one of said loudspeakers of said second loudspeaker system along a second axis at an acute angle to said first axis;

said first and second loudspeaker systems each being configured as the mirror image of the other.

3. Sound reproduction apparatus as defined in claim 1 wherein said acute angle is between about 60 to about 90 degrees.

4. Sound reproduction apparatus as defined in claim 2 wherein said acute angles are each between about 60 to about 90 degrees.

5. Sound reproduction apparatus as defined in claim 2 wherein said first and second loudspeaker systems are aligned so that the first axis of radiation along which sound is radiated by said first loudspeaker in said first loudspeaker system intersects the first axis of radiation along which sound is radiated by said at least one of loudspeakers in said second loudspeaker system at an angle of between about 60 to about 90 degrees.

6. Sound reproduction apparatus as defined in claim 2 wherein each of said mounting means of said first and second loudspeaker system comprises enclosure means with sides and having a gabled or V-shaped front portion characterized in having a pair of flat, vertical panels each joined to respective ones of said sides, and joined at an intersecting angle to one another at a forwardly projecting vertical ridge.

7. Sound reproduction apparatus as defined in claim 6 wherein said intersecting angle is between about 90 to about 120 degrees.

8. Sound reproduction apparatus as defined in claim 6 wherein said plurality of loudspeakers included in said first loudspeaker system includes:

at least a woofer, a mid-range speaker and a tweeter all connected for reproducing only said one of said stereophonic signals, and positioned in one of said panels; and at least another mid-range speaker connected for reproducing only said difference, and positioned in the other of said panels.

9. Sound reproduction apparatus as defined in claim 1 wherein said voice coil comprises a pair of coils wound in a center-tapped, series wound, four layer design with each two layers of each coil comprising an independent left or right channel.

10. Sound reproduction apparatus as defined in claim 1 wherein said dual voice coil comprises first and second coils;

said first coil being connected to receive said one of said stereophonic signals and to have a polarity opposite the polarity of said first of said loudspeakers of said first loudspeaker system;

said second coil being connected to receive said other of said stereophonic signals and to have the same polarity as said first of said loudspeakers of said first loudspeaker system.

11. Sound reproduction apparatus as defined in claim 2 wherein said dual voice coil in said another of said loudspeakers in said second loudspeaker system comprises first and second coils;

said first coil being connected to receive said other of said stereophonic signals and to have a polarity opposite the polarity of said at least one of said loudspeakers of said second loudspeakers systems;

said second coil being connected to receive said one of said stereophonic signals and to have the same polarity as said at least one of said loudspeakers of said second loudspeaker system.

12. Sound reproduction apparatus as defined in claim 6 wherein said plurality of loudspeakers included in said second loudspeaker system includes:

at least a woofer, a mid-range speaker and a tweeter all connected for reproducing only said other of said stereophonic signals, and positioned in one of said panels of said second loudspeaker system; and at least another mid-range speaker connected for reproducing only said difference, and positioned in said other of said panels.

* * * * *

UNITED STATES PATENT AND TRADEMARK OFFICE

CERTIFICATE OF CORRECTION

PATENT NO. : 4,847,904

DATED : July 11, 1989

INVENTOR(S) : Charles L. McShane

It is certified that error appears in the above-identified patent and that said Letters Patent is hereby corrected as shown below:

Claim 1, column 8, line 41, delete ":" and substitute therefor -- ; --;

Claim 1, column 8, line 42, delete "being-connected" and substitute therefor -- being connected --;

Claim 2, column 9, line 5, after "along" insert -- a --; and

Claim 6, column 9, line 31, delete "system" and substitute therefor -- systems --.

Signed and Sealed this

Tenth Day of April, 1990

*Attest:*

HARRY F. MANBECK, JR.

*Attesting Officer*

*Commissioner of Patents and Trademarks*